US007132991B1

(12) United States Patent
Li et al.

(10) Patent No.: US 7,132,991 B1
(45) Date of Patent: Nov. 7, 2006

(54) MINIATURE PLANAR NOTCH ANTENNA USING MICROSTRIP FEED LINE

(75) Inventors: Ching-Lieh Li, Taipei Hsien (TW); Jian-Ping Chang, Toufen Township, Miaoli County (TW)

(73) Assignee: Tamkang University, Taipei County (TW)

( * ) Notice: Subject to any disclaimer, the term of this patent is extended or adjusted under 35 U.S.C. 154(b) by 0 days.

(21) Appl. No.: 11/107,130

(22) Filed: Apr. 15, 2005

(51) Int. Cl.
*H01Q 13/10* (2006.01)

(52) U.S. Cl. ..... 343/767; 343/767

(58) Field of Classification Search ..... 343/767, 343/729

See application file for complete search history.

(56) References Cited

U.S. PATENT DOCUMENTS 4,587,524 A * 5/1986 Hall ..... 343/729
5,194,875 A * 3/1993 Lucas ..... 343/767
2005/0206572 A1* 9/2005 Apostolos ..... 343/767

* cited by examiner

*Primary Examiner*—Hoang V. Nguyen
*Assistant Examiner*—Dieu Hien Duong

(57) ABSTRACT

A miniature antenna for various wireless communication applications in the ISM band around 2.45 GHz is provided. The miniature antenna mainly contains a bended planar notch antenna with a metallic stub as a capacitive load. A microstrip feed line is also appropriately bended so as to achieve a significant reduction of the antenna's dimension. The miniature antenna could be implemented using simple manufacturing processes on a common circuit board without mechanical work or advanced processes such as low temperature co-fired ceramics. The antenna has a comparable performance to those antennas having much larger dimensions.

4 Claims, 6 Drawing Sheets

MINIATURE PLANAR NOTCH ANTENNA USING MICROSTRIP FEED LINE

BACKGROUND OF THE INVENTION

1. Field of the Invention

The present invention generally relates to antennas, and more particularly to a miniature planar notch antenna using microstrip feed line.

2. The Prior Arts

As mobile communications are gaining widespread popularity, device vendors are continuously squeezing complicated functions such as picture taking, video recording, MP3 playback, FM receiving, Internet connectivity, and even fingerprint identification into the already crowded mobile devices such as PDAs and handsets. As such, the antenna of these mobile computing or communications devices, as one of the most vital components, is required to scale down as much as possible without sacrificing its performance.

The industrial and academic arenas have been working on miniature antenna for some time already. The commonly known approaches include, for example, patch antenna using shorting pins, patch antenna with slot, antenna using meander patch, etc. Among them, chip antennas have been proven to be applicable to ISM (industrial, science, medical) band applications with a size below 10×10 $mm^2$. However, chip antennas usually employ a substrate with a high dielectric constant, a three-dimensional meander structure, or a patch structure, and advanced manufacturing processes such as multi-layered low temperature co-fired ceramics (LTCC). All these would lead to a significant increase of production cost and difficulty.

SUMMARY OF THE INVENTION

Accordingly, the major objective of the present invention is to provide a miniature antenna for applications in the microwave band around 2.45 GHz, whose dimension could be scaled down below 10×10 $mm^2$ without sacrificing its performance.

Another objective of the present invention is to provide a miniature antenna that could be achieved using low-cost manufacturing process on an ordinary substrate, instead of employing three-dimensional structure, mechanical drilling, or complicated processes such as LTCC.

To achieve the foregoing objectives, the present invention adopts an approach based on a planar notch antenna fed by a microstrip line. Notch antennas have already been proven to work appropriately with a total length around ¼ of the targeted wavelength. On the other hand, this approach could be implemented with ordinary processes on a common FR4 circuit board.

To further reduce the dimension of the proposed antenna, the present invention bends and turns the notch antenna at appropriate locations, but increases the antenna's effective length by introducing a metallic stub as a capacitive load for the notch antenna. The present invention also bends and turns the microstrip feed line so that the entire proposed antenna (including the notch antenna, the metallic stub, and a part of the microstrip feed line) are all within an area below 10×10 $mm^2$.

After experimentation, the proposed antenna could achieve a degree of performance very close to antennas having much larger dimensions. FIG. 1*a* is a frequency response diagram showing the reflection coefficient S11 of an embodiment of the present invention. As illustrated, the embodiment of the present invention has a center frequency at 2.43 GHz and its 10 dB bandwidth is around 190 MHz (7–8%). FIGS. 1*b* and 1*c* are the X-Z plane and Y-Z plane radiation pattern diagrams measured at 2.43 GHz of the same embodiment of the present invention as FIG. 1*a*. With reference to FIG. 1*b*, the embodiment has a rather uniform radiation pattern on the H plane (i.e., X-Z plane) with a maximum gain around 2.27 dBi. With reference to FIG. 1*c*, on the E plane (i.e., the Y-Z plane), the embodiment has the strongest cross-polarization at $\phi=90°$ (Y axis) while the co-polarization main beam is at the $\phi=0$ (Z axis) direction and has a maximum gain up to 3.29 dBi.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

The present invention is based on a planar notch antenna excited by a microstrip feed line. A planar notch antenna using a microstrip feed line has been already known for its various advantages such as light weight, small size, simple production, and easy integration.

Figure 2A:
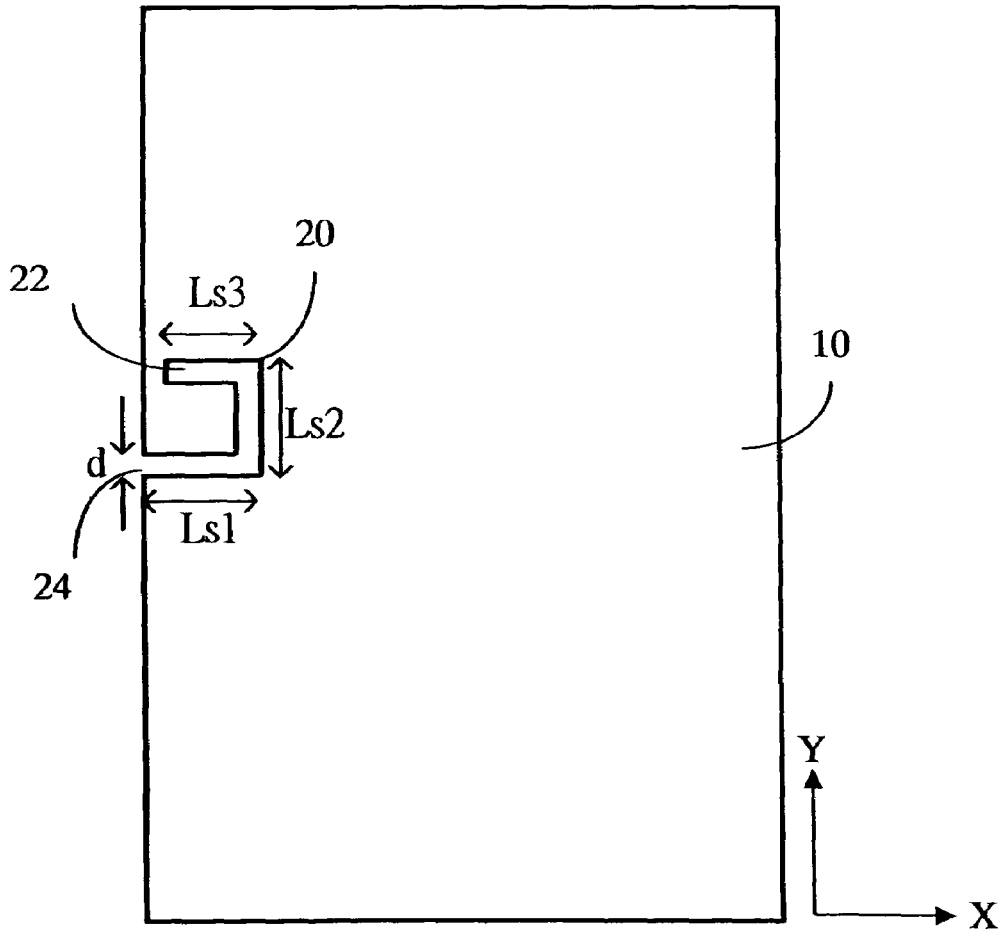
FIG. 2*a* is a schematic diagram showing a planar notch antenna according to an embodiment of the present invention.

Please refer to FIG. 2*a*, which is a schematic diagram showing a planar notch antenna according to an embodiment of the present invention. The present embodiment is implemented by etching a notch antenna 20 on the ground side 10 of a FR4 circuit board (not numbered) having a thickness of 0.8 mm. The notch antenna 20 has a short-circuited end 22 and an open-circuited end 24. Theoretically, such a notch antenna could have a total length smaller than ¼ of the center wavelength of the notch antenna's targeted frequency band. Using the ISM band around 2.45 GHz as example, a notch antenna for this band could have a total length smaller than 22 mm. To further reduce its dimension, the present embodiment bends the notch antenna 20 for a right-angled turn twice into an inverted-J shape as shown in FIG. 2*a*. In the present embodiment, the lengths of the various sections of the notch antenna 20 are: Ls1=5.3 mm, Ls2=5.2 mm, Ls3=4.3 mm. The notch width d at the open-circuited end 24 is 1 mm. Please note that a notch antenna according to the present invention is not limited to having exactly two right-angled turns. The characteristic of the notch antenna according to the present invention is that, in order to reduce its dimension, the notch antenna could be bended (but not required) at least once for an arbitrary angle without crossing itself.

Figure 2B:
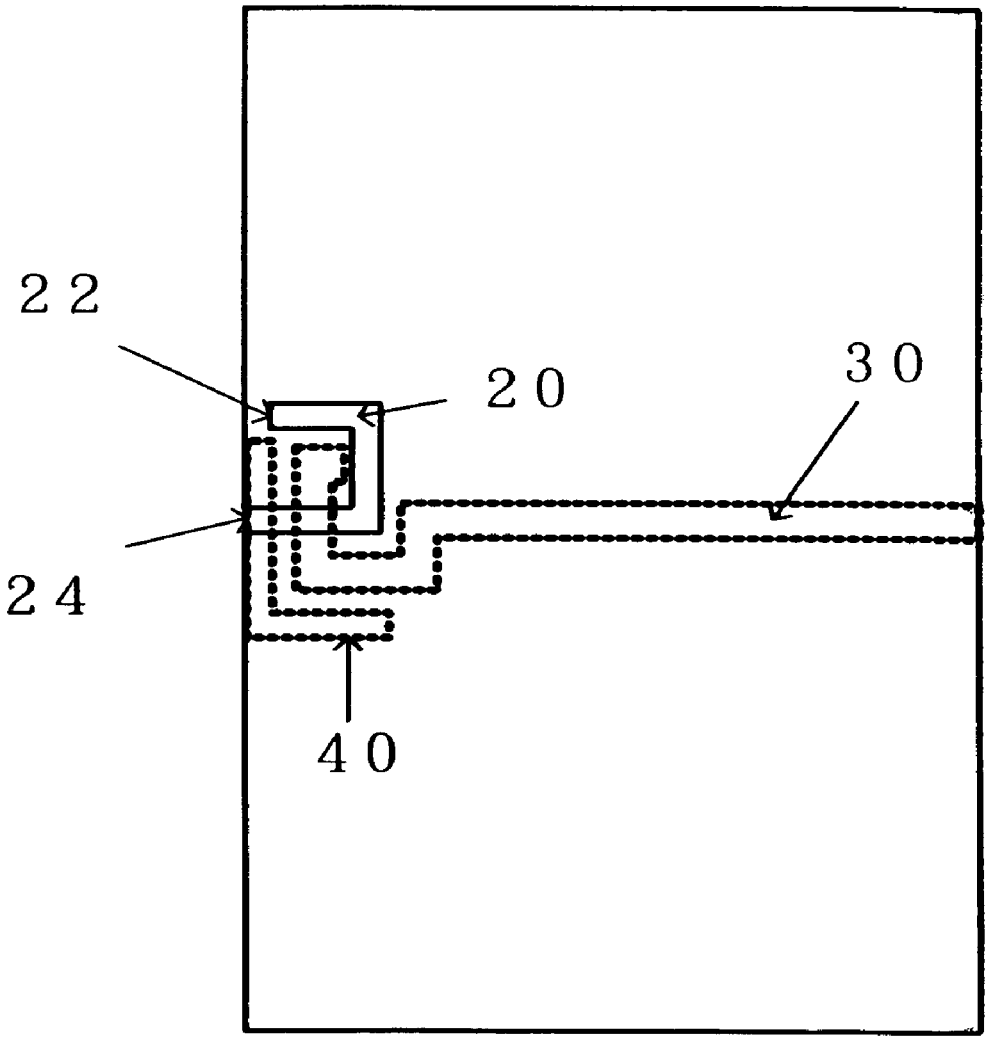
FIG. 2*b* is a schematic diagram showing a microstrip feed line and a metallic stub according to an embodiment of the present invention along with the notch antenna as depicted in FIG. 2*a*.
Figure 2C:
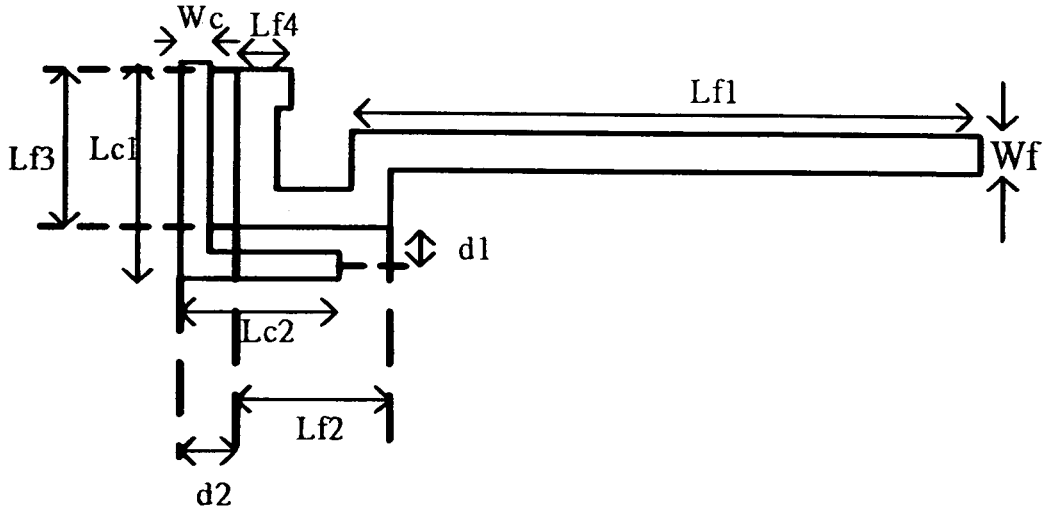
FIG. 2*c* is a schematic diagram showing the lengths of the various sections of the microstrip feed line and the metallic stub as depicted in FIG. 2*b*.

Please refer to FIG. 2*b*. The present embodiment forms a microstrip feed line 30 on the other side of the FR4 circuit board directly opposite to the ground side 10. The microstrip feed line 30 is for the excitation for the notch antenna 20. The microstrip feed line 30 has an appropriate width for forming a 50-ohm characteristic impedance and an appropriate length for impedance matching for the notch antenna 20. In the present embodiment, the microstrip feed line 30, in order to match the shape of the notch antenna 20, is bended for a right-angled turn three times and passes astride the notch antenna 20 somewhere along the notch antenna 20. Again, please note that a microstrip feed line according to the present invention is not required to have exactly three right-angled turns. The characteristics of the microstrip feed line according to the present invention are, to match the shape of the notch antenna, the microstrip feed line is bended at least once for an arbitrary angle without crossing itself and passes astride the notch antenna. In the present embodiment, as shown in FIG. 2*c*, the lengths of the various sections of the microstrip feed line 30 are: Wf=1.4 mm, Lf1=21.96 mm, Lf2=5.41 mm, Lf3=5.77 mm, and Lf4=1.86 mm.

The present embodiment then forms a metallic stub 40 on the same side where the microstrip feed line 30 is located, as a capacitive load to the notch antenna 20 so as to increase the effective length of the notch antenna 20. In the present embodiment, in order to match the shape of the notch antenna 20, the metallic stub 40 is bended for a right-angled turn once into an L shape, maintains an appropriate distance from the microstrip feed line 30, and passes astride the notch antenna 20 somewhere along the notch antenna 20. Please note that the metallic stub according to the present invention is not required to have an L shape. The characteristics of the metallic stub according to the present invention are, in order to match the shape of the notch antenna, the metallic stub could be (but not required) bended at least once for an arbitrary angle without crossing itself, passes astride the notch antenna somewhere along the notch antenna, and is positioned at a side of the microstrip feed without intersecting the microstrip feed line. In the present embodiment, as shown in FIG. 2*c*, the lengths of the various sections of the metallic stub 40 are: Wc=1 mm, Lc1=7.94 mm, and Lc2=5.41 mm, while the distances between the metallic stub 40 and the microstrip feed line 30 are: d1=0.41 mm and d2=1.91 mm.

Figure 1A:
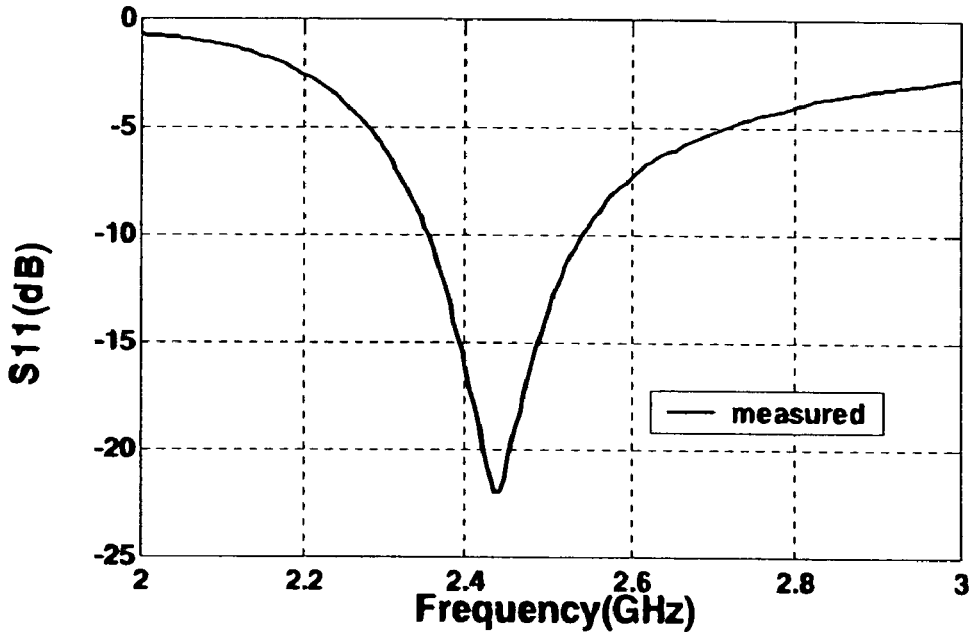
FIG. 1*a* is a frequency response diagram showing the, reflection coefficient S11 of an embodiment of the present invention.
Figure 1B:
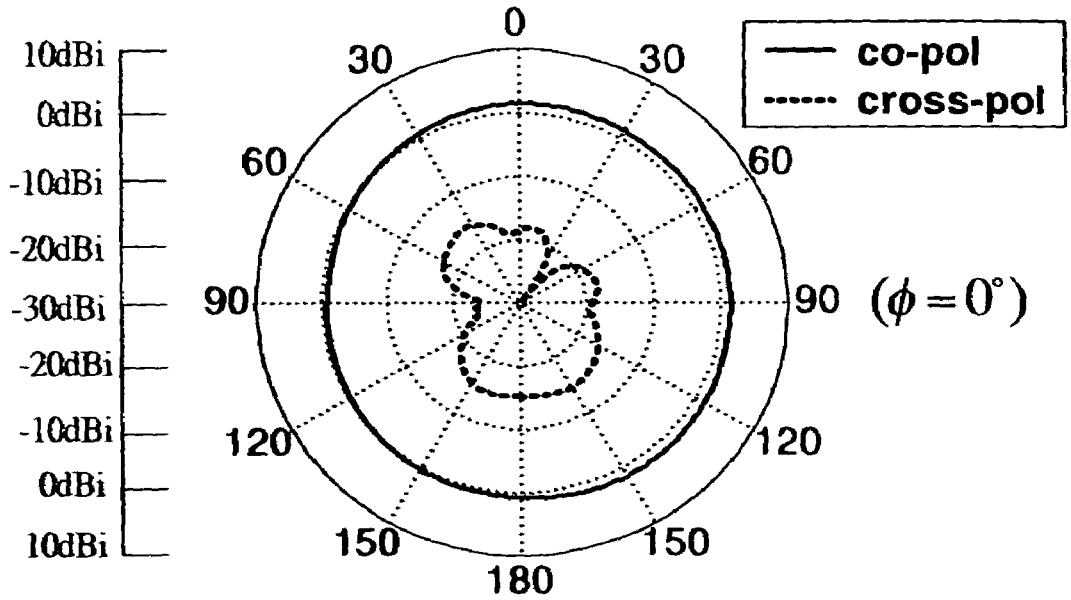
FIG. 1*b* is a radiation pattern diagram measured on the X-Z plane at 243 GHz of the same embodiment of the present invention as FIG. 1*a*.
Figure 1C:
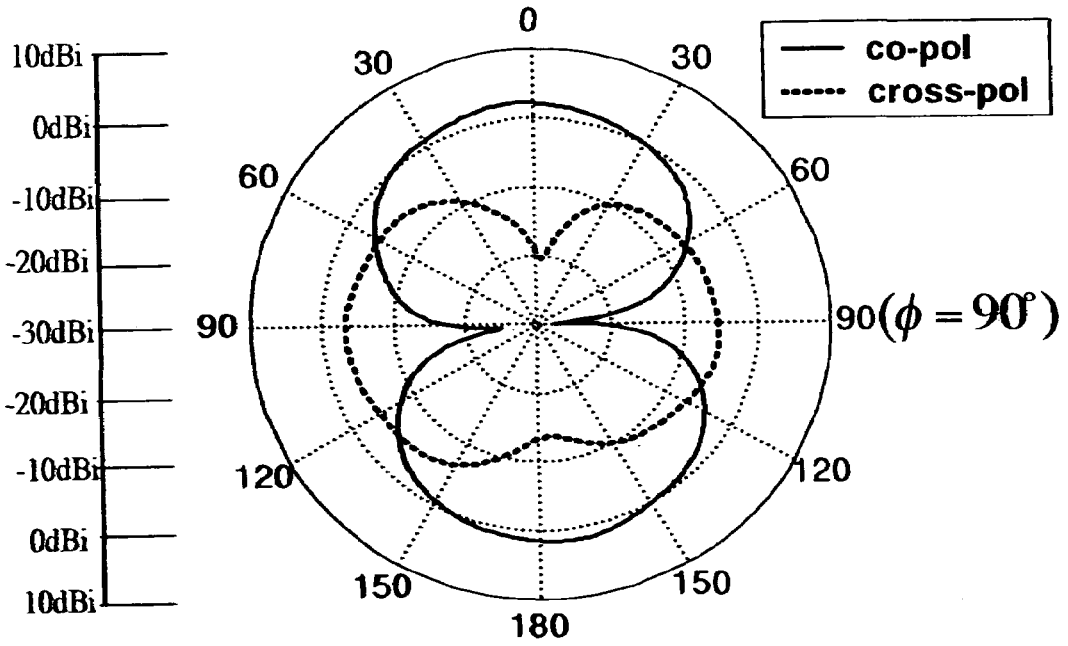
FIG. 1*c* is a radiation pattern diagram measured on the Y-Z plane at 243 GHz of the same embodiment of the present invention as FIG. 1*a*.

The entire antenna of the present embodiment (including the notch antenna, the metallic stub, and a part of the microstrip feed line) is all within an area 7.94×7.41 $mm^2$. As shown in FIGS. 1*a*, 1*b*, and 1*c*, the present embodiment radiates at the center frequency 2.43 GHz with 7~8% bandwidth, while the gain up to 3.29 dBi is achieved. Compared to other antennas having much larger dimensions, the antenna of the present invention enjoys a comparable performance, but requires only simple manufacturing processes on a common FR4 circuit board.

Although the present invention has been described with reference to an embodiment, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A miniature planar notch antenna implemented on a circuit board for sending and receiving wireless signals in a microwave band, comprising:

a notch antenna positioned on a ground side of said circuit board having a linear shape without crossing itself and having a first length and a first width, said notch antenna being bended at least twice;

a metallic stub positioned on the other side of said circuit board opposite to said ground side having a linear shape without crossing itself and having a second length and a second width, said metallic stub passing astride said notch antenna at a first location of said notch antenna; and a microstrip feed line positioned on the same side of said circuit board as said metallic stub having a linear shape without crossing itself and having a third length and a third width, said microstrip feed line bended at least once for an appropriate angle, said microstrip feed line positioned at a side to said metallic stub with an appropriate distance therebetween without intersecting said metallic stub, said microstrip feed line passing astride said notch antenna at a second location of said notch antenna.

2. The miniature planar notch antenna as claimed in claim 1, wherein said notch antenna has three sections and two right-angle turns.

3. The miniature planar notch antenna as claimed in claim 1, wherein said metallic stub is bended at least once for an appropriate angle.

4. The miniature planar notch antenna as claimed in claim 1, wherein said metallic stub is a capacitive load to said notch antenna.

* * * * *